US009556569B2

(12) United States Patent
Oetken

(10) Patent No.: US 9,556,569 B2
(45) Date of Patent: Jan. 31, 2017

(54) SCREED SYSTEM FOR PAVING MACHINE

(71) Applicant: Caterpillar Paving Products Inc., Brooklyn Park, MN (US)

(72) Inventor: Nicholas A. Oetken, Brookyln Park, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 50 days.

(21) Appl. No.: 14/735,665

(22) Filed: Jun. 10, 2015

(65) Prior Publication Data

US 2016/0362851 A1 Dec. 15, 2016

(51) Int. Cl.

| | |
|---|---|
| ***E01C 23/14*** | (2006.01) |
| ***E01C 19/48*** | (2006.01) |
| ***E01C 7/00*** | (2006.01) |
| ***E01C 19/08*** | (2006.01) |
| ***E01C 19/42*** | (2006.01) |

(52) U.S. Cl.

CPC ..... *E01C 19/4873* (2013.01); *E01C 7/00* (2013.01); *E01C 19/08* (2013.01); *E01C 19/42* (2013.01)

(58) Field of Classification Search

CPC ..... E01C 7/00; E01C 19/08; E01C 19/42; E01C 19/4873

USPC ..... 404/77, 79, 95, 118

See application file for complete search history.

(56) References Cited

U.S. PATENT DOCUMENTS

| | | | | |
|---|---|---|---|---|
| 4,752,155 A | | 6/1988 | Rennich | |
| 5,899,630 A | * | 5/1999 | Brock | E01C 19/48 404/118 |

FOREIGN PATENT DOCUMENTS

| | | |
|---|---|---|
| DE | 2614157 | 10/1977 |
| DE | 102004007088 | 8/2005 |
| FR | 2436850 | 4/1980 |
| GB | 2081779 | 11/1983 |
| JP | 3447204 | 9/2003 |

* cited by examiner

*Primary Examiner* — Raymond W Addie

(57) ABSTRACT

A screed system for a paving machine. The screed system includes a screed plate coupled to a screed frame of the paving machine. The screed plate includes a primary heating member. The screed system further includes a secondary heating member movably coupled to the screed frame and disposed to a rear end of the screed plate.

20 Claims, 5 Drawing Sheets

SCREED SYSTEM FOR PAVING MACHINE

TECHNICAL FIELD

The present disclosure relates to a screed system for a paving machine and a method of paving a work surface by the paving machine.

BACKGROUND

Paving machines are generally used for laying paving materials, such as asphalt, on a work surface. The paving machine includes a screed system disposed behind the paving machine to receive the paving material from a hopper and deposit the paving material on the work surface. The screed system includes a screed plate for levelling the paving material with respect to the work surface and for heating a layer of the paving material laid on the work surface. Heating of the paving material causes effective compaction of the paving material by a compactor that follows the paving machine. However, when the paving machine stops for an extended period of time, for example, to receive paving material from a truck, a portion of the work surface behind the screed plate becomes inaccessible to the compactor. Additionally, during the machine stoppage, the portion of the work surface behind the screed will cool off. When the paving machine resumes movement, compaction will be difficult on that uncompacted portion of the work surface that cooled off during the stoppage.

U.S. Pat. No. 4,752,155 (the '155 patent) discloses a paving machine having a moveable heater. The moveable heater is used for heating a road surface prior to applying paving material on the road surface. The paving machine has a frame mounted for movement along the road and the moveable heater is mounted on sides of the frame. The heater is movable between a first position at which it is capable of heating a width of the road to be paved and a second position at which the heater is stored for movement with the frame and spans a width less than the width of road to be paved. In the '155 patent, the paving machine needs a width more than the width of the road for moving the heaters from the first position to the second position. This may limit application of the paving machine as the movement of the heaters may interfere with surroundings and may further cause actuation of the heaters a cumbersome process.

SUMMARY OF THE DISCLOSURE

In one aspect of the present disclosure, a screed system for a paving machine is provided. The screed system includes a screed plate coupled to a screed frame of the paving machine. The screed plate includes a primary heating member. The screed system further includes a secondary heating member movably coupled to the screed frame and disposed to a rear end of the screed plate.

In another aspect of the present disclosure, a paving machine is provided. The paving machine includes a screed system having a screed frame and a screed plate coupled to the screed frame. The screed plate includes a primary heating member. The screed system further includes a secondary heating member movably coupled to the screed frame and disposed to a rear end of the screed plate. The screed system further includes an actuator coupled to the secondary heating member and the screed frame to move the secondary heating member between a first position and a second position.

In yet another aspect of the present disclosure, a method of paving a work surface by a paving machine is provided. The method includes moving a screed plate relative to the work surface and heating a first portion of the work surface below the screed plate via a primary heating member. The method further includes moving a secondary heating member proximal to a second portion of the work surface adjacent to the first portion of the work surface and heating the second portion of the work surface via the secondary heating member.

Other features and aspects of this disclosure will be apparent from the following description and the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
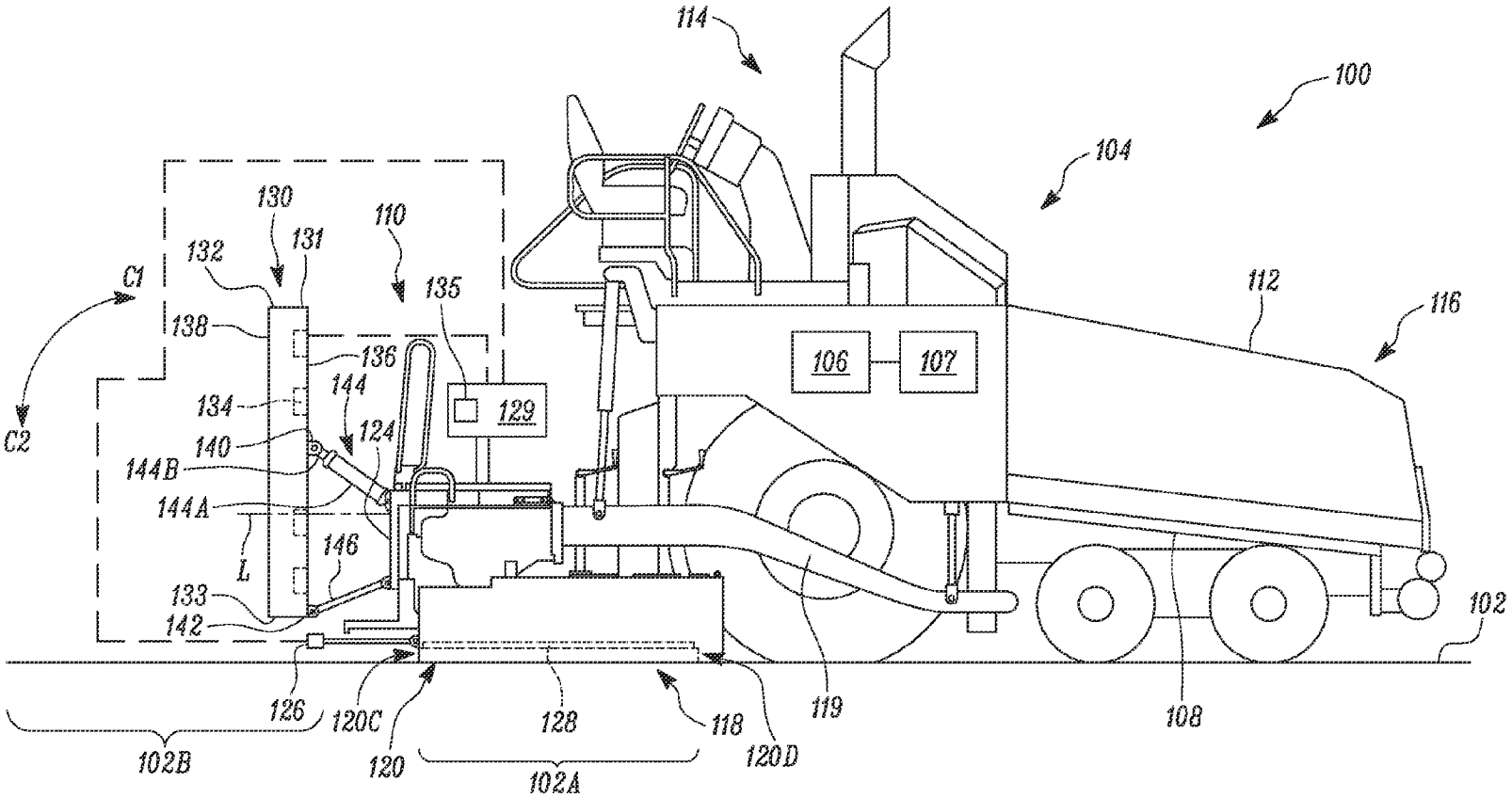
FIG. 1 is a side view of a paving machine having a secondary heating member, according to one embodiment of the present disclosure.

FIG. 1 illustrates a side view of a paving machine 100, according to an embodiment of the present disclosure. The paving machine 100 may be used for laying paving materials, such as asphalt, on a work surface 102 to build a roadway. The paving machine 100 includes a tractor 104 to propel the paving machine 100. In the illustrated embodiment, the tractor 104 is a wheel type tractor. In other embodiments, the tractor 104 may be a track type tractor.

The paving machine 100 further includes an engine 106 for propelling the tractor 104. The engine 106 is disposed within the tractor 104. The paving machine 100 further includes a generator 107 drivably coupled to the engine 106. The generator 107 is configured to supply electric power to various electric components of the paving machine 100 including, but not limited to, lights and other electric devices.

The tractor 104 includes a chassis 108 configured to support various components of the paving machine 100 including a screed system 110, a hopper 112 and an operator station 114. The hopper 112 is disposed adjacent to a front end 116 of the paving machine 100 for receiving the asphalt from a truck. The operator station 114 is disposed adjacent to a rear end 118 of the paving machine 100. The operator station 114 includes a control panel (not shown) for an operator to control various operations, such as the paving operation of the paving machine 100. The screed system 110 is disposed adjacent to the rear end 118 of the paving machine 100 behind the operator station 114.

The screed system 110 is coupled to the chassis 108 of the tractor 104 via a pair of arms 119. One arm 119 of the pair of arms 119 is shown in FIG. 1. The screed system 110 is configured to receive the asphalt from the hopper 112 and deposit the asphalt on the work surface 102. The screed system 110 is further configured to level the asphalt deposited on the work surface 102 and may maintain a thickness for a layer of the deposited asphalt with reference to the work surface 102.

Figure 2:
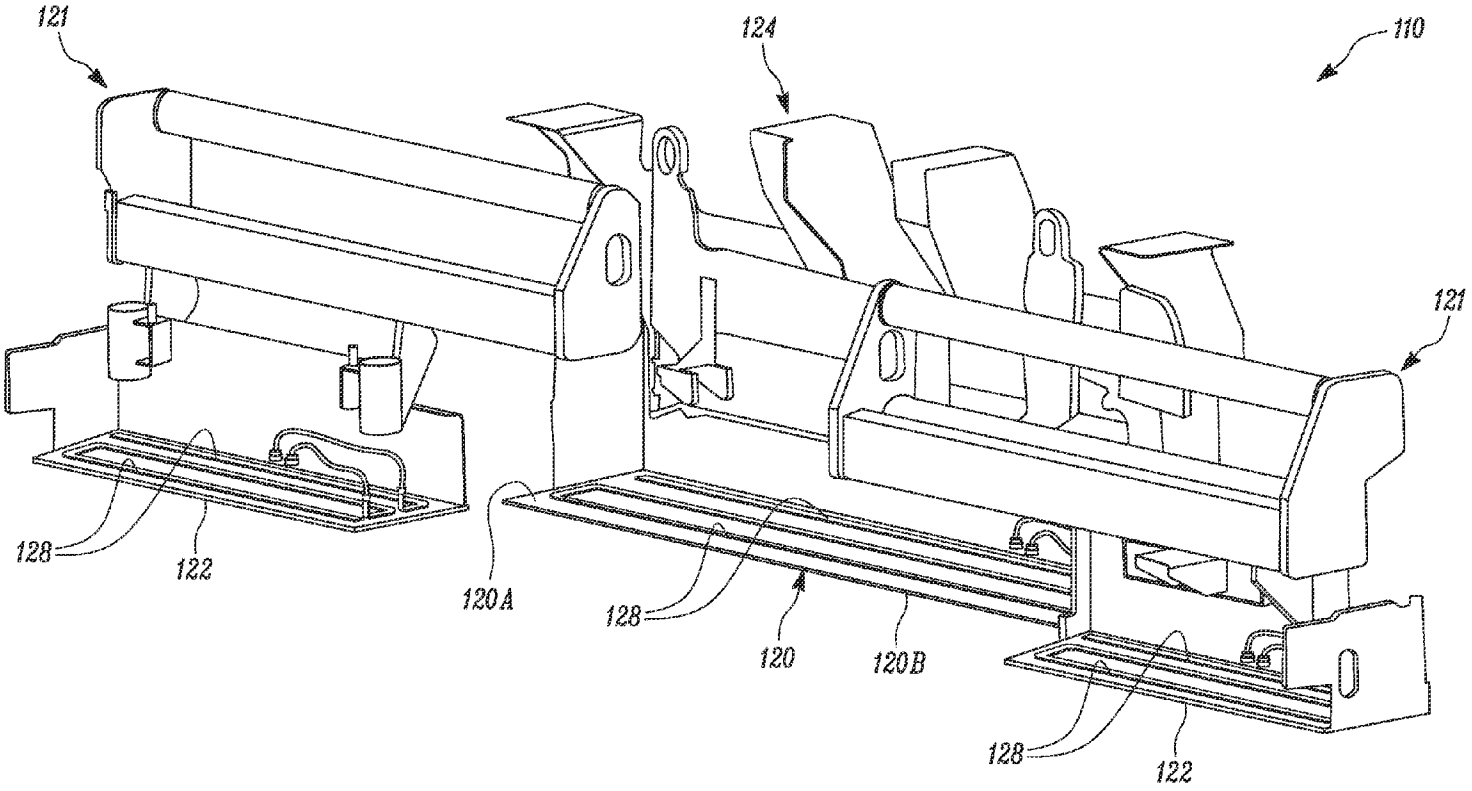
FIG. 2 is a perspective view of a screed system of the paving machine.

Referring to FIGS. 1 and 2, the screed system 110 includes a screed plate 120 and a pair of extension plates 122. Each of the pair of extension plates 122 is disposed laterally adjacent to the screed plate 120. The screed system 110 further includes a screed frame 124 to support the screed plate 120. Similarly, the extension plates 122 are supported on extension screed frames 121 of the screed system 110. The screed plate 120 and the extension plates 122 are configured to be in contact with the work surface 102 to level the deposited asphalt with respect to the work surface 102. The screed frame 124 may be adjusted angularly about a longitudinal axis 'L' and may be moved up and down relative to the work surface 102 to define the layer of the asphalt on the work surface 102. The extension screed frames 121 supporting the extension plates 122 may also be adjusted in a vertical direction and in a lateral direction to define the thickness of the layer of the asphalt and a paving width, respectively.

The screed system 110 further includes a primary heating member 128 disposed on the screed plate 120. The primary heating member 128 heats the screed plate 120 which in turn heats a first portion 102A of the work surface 102 disposed below the screed plate 120. The primary heating member 128 may be communicably coupled to a controller 129. The controller 129 is configured to be in communication with the generator 107 to selectively cause heating of the primary heating member 128 based on an input from the operator. In an embodiment, the controller 129 may include one or more control panels disposed within the operator station 114 and/or the screed system 110. The control panel may communicate with the generator 107 to provide the electric power to the primary heating member 128 based on the input from the operator. Further, the control panel may include one or more control switches and/or a display screen for facilitating the operator to actuate the primary heating member 128 and the electric devices. In an example, the primary heating member 128 may be a resistive heating element.

In an embodiment, the screed plate 120 includes a rear end 120C and a front end 120D distal to the rear end 120C. The screed plate 120 may further define a width extending between the rear end 120C and the front end 120D. The screed plate 120 further includes a top surface 120A and a bottom surface 120B extending between the front end 120D and the rear end 120C thereof. The primary heating member 128 is disposed on the top surface 120A. The bottom surface 120B contacts with the work surface 102. Similarly, the primary heating members 128 are disposed on the pair of extension plates 122.

In an embodiment, the first portion 102A of the work surface 102 may correspond to a surface area of the work surface 102 located below the bottom surface 120B of the screed plate 120. Further, the first portion 102A of the work surface 102 may also include a surface area of the work surface 102 located below the extension plates 122.

During the paving operation, the electric power may be supplied to the primary heating member 128 disposed on the screed plate 120 and the extension plates 122. The screed plate 120 and the extension plates 122 may be made from a heat conducting material, such as a metal or metallic alloy, such that the primary heating member 128 may dissipate the heat to the screed plate 120 and the extension plates 122. Thus, the screed plate 120 and the extension plates 122 cause heating of the first portion 102A of the work surface 102. The heated work surface 102 may be further compacted by a compactor that follows the paving machine 100 during the paving operation.

Referring to FIG. 1, the screed system 110 further includes a secondary heating member 130 disposed to the rear end 120C of the screed plate 120. The secondary heating member 130 is configured to selectively heat a second portion 102B of the work surface 102 located behind the first portion 102A of the work surface 102.

During the paving operation, the asphalt laid on the work surface 102 is heated by the primary heating member 128, such that the compactor may compact the layer of asphalt before the layer of the asphalt loses the heat provided by the primary heating member 128. However, when there is no asphalt in the hopper 112, the paving machine 100 may halt for an extended period of time to receive the asphalt from the truck or any other vehicle. During such an extended period of time, a portion of the work surface 102 behind the screed plate 120 is not accessible for compaction since the compactor has to be located at a minimum distance from the paving machine 100 to prevent contact with various components of the screed system 110. The portion of the work surface 102 behind the screed plate 120 may correspond to the second portion 102B of the work surface 102. Hence, the secondary heating member 130 is disposed on the second portion 102B of the work surface 102 to heat the second portion 102B and to facilitate effective compaction of the asphalt laid on the second portion 102B of the work surface 102.

In one embodiment of the present disclosure, the secondary heating member 130 includes an elongate body 132 having a length substantially equal to or greater than a maximum width of the screed system 110 defined by the screed plate 120 and the extension plates 122. The elongate body 132 of the secondary heating member 130 may also be made adjustable along the length thereof to define lengths corresponding to different widths defined by the laterally adjustable extension plates 122. Further, the elongate body 132 may have a width extending between a first end 131 and a second end 133. The width of the elongate body 132 may be substantially equal to or greater than a width of the second portion 102B of the work surface 102 measured along the longitudinal axis 'L'. Thus, the length and the width of the elongate body 132 of the secondary heating member 130 are adapted to cover the second portion 102B of the work surface 102.

The secondary heating member 130 further includes a heat conducting element 134 detachably coupled on the elongate body 132 via one or more support members (not shown). The support members may be coupled to the elongate body 132 via fastening members. The elongate body 132 includes a top surface 136 and a bottom surface 138 distal to the top surface 136. The heat conducting element 134 is disposed on the top surface 136 of the elongate body 132. The bottom surface 138 of the elongate body 132 is configured to be in contact with the second portion 102B of the work surface 102. The elongate body 132 may be made from heating conducting materials, such as a metal or metallic alloy. In an example, the heat conducting element 134 may be a resistive heating element.

The secondary heating member 130 is in communication with the controller 129. The controller 129 is configured to selectively cause heating of the secondary heating member 130. Specifically, the heat conducting element 134 of the secondary heating member 130 is coupled to the controller 129 to receive the electric power generated by the generator 107. The electric power may be supplied to the heat conducting element 134 based on an input from the operator. Further, a rating of the electric power, such as a current and a voltage, may be defined based on specification of the heat conducting element 134 and the elongate body 132. In another embodiment, a separate controller may be disposed in the paving machine 100 to selectively cause heating of the secondary heating member 130.

The secondary heating member 130 further includes a first coupling member 140 disposed on the elongate body 132 between the first end 131 and the second end 133. Specifically, the first coupling member 140 may be disposed on the top surface 136 of the elongate body 132. The secondary heating member 130 further includes a second coupling member 142 disposed on the elongate body 132 adjacent to the second end 133 thereof. Specifically, the second coupling member 142 may be disposed on the top surface 136 of the elongate body 132. However, it may be contemplated that the first and second coupling members 140, 142 may be disposed at any location on the elongate body 132 as desired.

The screed system 110 further includes an actuator 144 coupled to the secondary heating member 130 to move the secondary heating member 130 between a first position 'C1' and a second position 'C2' relative to the screed frame 124. In the first position 'C1', as illustrated in FIG. 1, the secondary heating member 130 is distal to the second portion 102B of the work surface 102. In the second position 'C2', the secondary heating member 130 is proximal to the second portion 102B of the work surface 102 to heat the second portion 102B.

In the illustrated embodiment, the actuator 144 is a linear actuator, such as a hydraulic cylinder, configured to be in communication with a hydraulic system of the paving machine 100. The actuator 144 includes a cylinder 144A coupled to the screed frame 124. The actuator 144 further includes a piston 144B slidably disposed within the cylinder 144A. The piston 144B is pivotally coupled to the first coupling member 140 of the secondary heating member 130. The actuator 144 is configured to be moved between a retracted position and an extended position based on an actuation by the hydraulic system. The retracted position of the actuator 144 may correspond to the first position 'C1' of the secondary heating member 130 and the extended position of the actuator 144 may correspond to the second position 'C2' of the secondary heating member 130. Although the cylinder 144A of the actuator 144 is coupled to the screed frame 124, it may be contemplated that the cylinder 144A of the actuator 144 may be coupled to any location on the screed system 110 or the paving machine 100.

In an example, one or more control valves may be disposed in the hydraulic system to control a flow of fluid to the actuator 144. Further, one or more control levers or switches may be disposed in the operator station 114 to actuate the one or more control valves to control the flow of the fluid to the actuator 144. In one example, the actuator 144 may be a double acting cylinder. In another example, the actuator 144 may be a single acting cylinder. In various other embodiments, the actuator 144 may be a rotary actuator, such as an electric motor or a hydraulic motor. Further, the actuator 144 may be any type of actuators known in the art, which may be driven by an electric system or the hydraulic system of the paving machine 100. It may also be contemplated that the secondary heating member 130 may be manually moved between the first position 'C1' and the second position 'C2'.

The screed system 110 further includes a link member 146 pivotally coupled to the screed frame 124 and the second coupling member 142 of the secondary heating member 130. During movement of the actuator 144 between the retracted position and the extended position, the secondary heating member 130 moves between the first position 'C1' and the second position 'C2', respectively, about the link member 146.

Referring to FIG. 1, the screed system 110 further includes a temperature sensor 126 coupled to the screed frame 124. The temperature sensor 126 is located above the second portion 102B of the work surface 102 to generate signals indicative of a temperature of the second portion 102B of the work surface 102. The temperature sensor 126 may be coupled to any suitable location on the screed frame 124 or the screed system 110. The temperature sensor 126 is further communicated with the controller 129. The controller 129 is configured to determine a temperature of the second portion 102B of the work surface 102 based on signals received from the temperature sensor 126.

In an exemplary embodiment, the temperature sensor 126 may be moveably coupled to the screed frame 124 via an actuator such that, in the second position 'C2' of the secondary heating member 130, the temperature sensor 126 may be moved to another position to avoid interference between the secondary heating member 130 and the temperature sensor 126. In such a case, the controller 129 may communicate with the actuator to move the temperature sensor 126 to another position.

Figure 3:
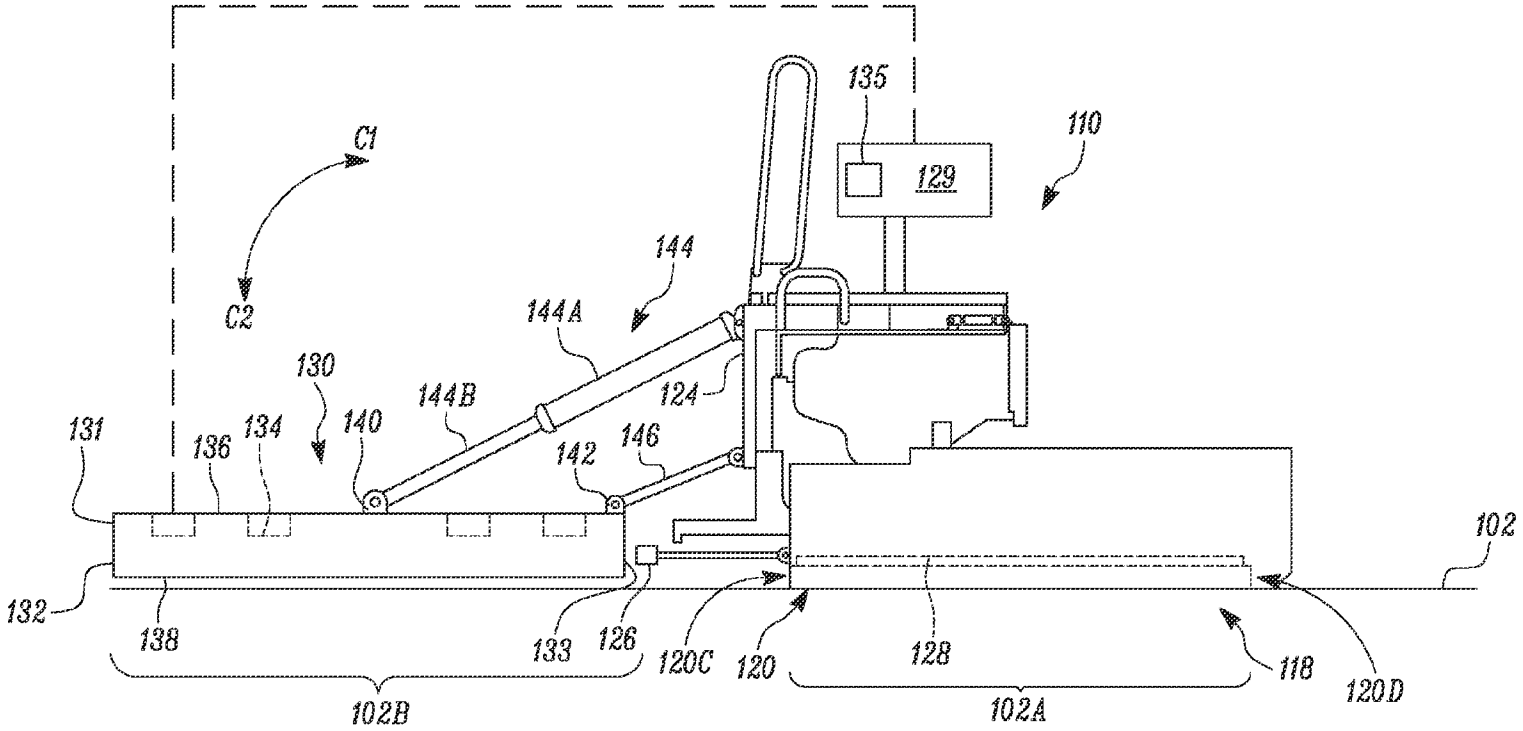
FIG. 3 is a side view of the screed system of the paving machine showing a second position of the secondary heating member of FIG. 1.

FIG. 3 illustrates the second position 'C2' of the secondary heating member 130. During a stationary stage of the paving operation, a timer 135 measures a time that the paving machine 100 has been stationary. In the illustrated embodiment, the timer 135 is integrated with the controller 129. The timer 135 is configured to measure the time of the stationary stage of the paving machine 100 based on various operating parameters of the paving machine 100, such as a speed of the paving machine 100. The controller 129 may be configured to determine various operating parameters of the paving machine 100 based on a plurality of sensors (not shown), such as a speed sensor, located in the paving machine 100. Each of the plurality of sensors may generate signals indicative of the corresponding operating parameter of the paving machine 100. In another embodiment, the timer 135 may be a separate device located at any location in the paving machine 100. In such a case, the timer 135 may be further communicated with the controller 129 to determine the time that the paving machine 100 has been stationary.

If the measured time matches or exceeds a preset time, then the controller 129 communicates with the actuator 144 to move the secondary heating member 130 from the first position 'C1' to the second position 'C2'. The preset time may be defined by the operator and given as an input to the controller 129 before start of the paving operation. In an example, the preset time may correspond to a time period after which a temperature of the second portion 102B may fall below a minimum temperature required for effective compaction.

In another embodiment, the controller 129 determines the temperature of the second portion 102B based on the signals received from the temperature sensor 126. If the sensed temperature drops below a preset temperature, then the controller 129 communicates with the actuator 144 to move the secondary heating member 130 from the first position 'C1' to the second position 'C2'. The preset temperature may be defined by the operator and given as an input to the controller 129 before start of the paving operation. In an example, the preset temperature may correspond to a temperature of the second portion 102B required for effective compaction thereof.

In yet another embodiment, the operator may actuate the control valve to control a flow of the fluid to the actuator 144 from the hydraulic system, such that the actuator 144 may move to the extended position. Due to movement of the actuator 144 from the retracted position to the extended position, the secondary heating member 130 moves from the first position 'C1' to the second position 'C2'. In the second position 'C2', the secondary heating member 130 may be disposed on the second portion 102B of the work surface 102. Further, the bottom surface 138 of the elongate body 132 may contact with the layer of the asphalt formed on the second portion 102B of the work surface 102. Further, a gap may be defined between the bottom surface 138 of the elongate body 132 and the layer of the asphalt depending on an amount of heat to be dissipated to the layer of the asphalt.

The controller 129 may be further actuated to supply the electric power to the heat conducting element 134. Rating of the electric power may be defined based on the amount of heat to be provided on the layer of the asphalt located in the second portion 102B of the work surface 102. The heat conducting element 134 may further dissipate the heat to the elongate body 132 which in turn dissipate the heat to the asphalt laid on the second portion 102B of the work surface 102. Thus a desired temperature of the asphalt laid on the second portion 102B is maintained during entire time period of the stationary stage of the paving operation to enable effective compaction of the asphalt.

Figure 4:
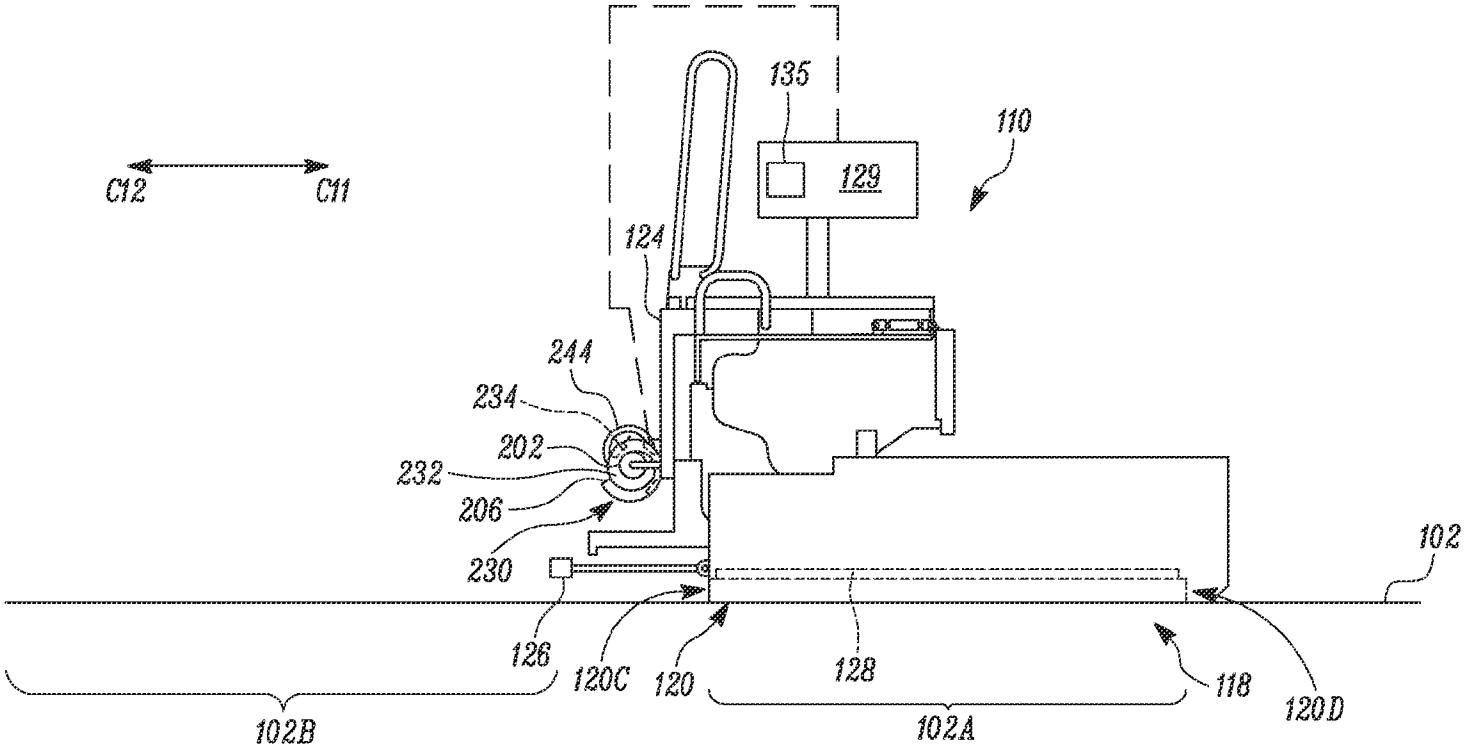
FIG. 4 is a side view of the screed system showing a first position of a secondary heating member, according to another embodiment of the present disclosure.

FIG. 4 illustrates a side view of the screed system 110 showing a secondary heating member 230, according to another embodiment of the present disclosure. In the illustrated embodiment, the secondary heating member 230 is a heated blanket. The secondary heating member 230 is configured to heat the second portion 102B of the work surface 102 during the stationary stage of the paving operation. The secondary heating member 230 may have a length and a width adapted to cover a surface area defined by the second portion 102B of the work surface 102. The length of the secondary heating member 230 may be measured along the longitudinal axis 'L' and the width of the secondary heating member 230 may be measured along a lateral axis perpendicular to the longitudinal axis 'L'. The secondary heating member 230 is configured to be moveable between a first position 'C11' and a second position 'C12'. In the first position, the secondary heating member 230 is distal to the second portion 102B of the work surface 102. In the second position 'C12', the secondary heating member 230 is proximal to the second portion 102B of the work surface 102 to heat the second portion 102B. The first position 'C11' of the secondary heating member 230 is shown in FIG. 4.

In an exemplary embodiment, the secondary heating member 230 includes a heat conducting element 234 coupled to a blanket 232. The heat conducting element 234 may be coupled to the blanket 232 via fastening members (not shown). In an example, the heat conducting element 234 may be a resistive heating element. The secondary heating member 230 is further communicably coupled to the controller 129. The controller 129 selectively causes heating of the secondary heating member 230 similar to the heating of the secondary heating member 130.

In an embodiment, the screed system 110 includes an actuator 244 coupled to the screed frame 124 to move the secondary heating member 230 between the first position 'C11' and the second position 'C12'. In an example the actuator 244 may be a rotary actuator, such as an electric motor. The electric motor may be configured to be in communication with an electric system of the paving machine 100. The electric system includes the generator 107. The actuator 244 may move the secondary heating member 230 between the first position 'C11' and the second position 'C12' based on an input from the operator. The actuator 244 may be configured to receive the electric power from the generator 107. In another example, the actuator 244 may be communicably coupled to the controller 129. The controller 129 may control a speed of the actuator 244 based on the electric power supplied by the generator 107.

Further, a spool 202 may be rotatably disposed in the screed system 110. The spool 202 may be further operatively coupled to the actuator 244 to receive a power therefrom. The actuator 244 may rotate the spool 202 based on the input from the operator. A first end 204 (shown in FIG. 5), defined along the length of the secondary heating member 230, may be coupled to the spool 202 such that a clock wise rotation of the spool 202 may cause the secondary heating member 230 to move to the first position 'C11'. Specifically, in the first position 'C11', the secondary heating member 230 may be rolled around the spool 202 and disposed distal from the second portion 102B of the work surface 102. Further, the actuator 244 may be actuated to rotate the spool 202 in an anti-clock wise direction such that the secondary heating member 230 may move to the second position 'C12'. However, it may be contemplated that a second end 206 of the secondary heating member 230 may be manually pulled behind the paving machine 100 to move the secondary heating member 230 to the second position 'C12'.

Figure 5:
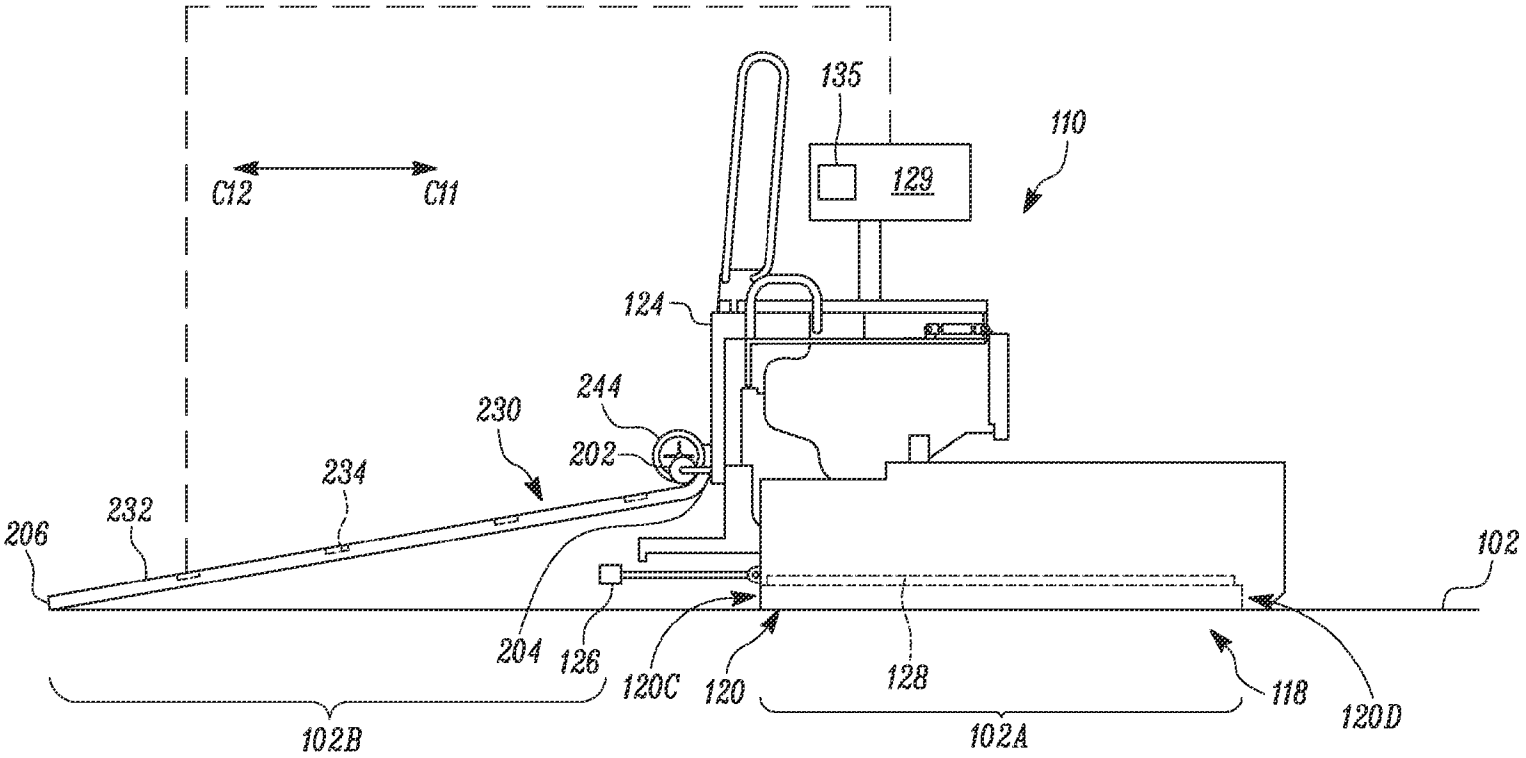
FIG. 5 is a side view of the screed system showing a second position of the secondary heating member of FIG. 4.

FIG. 5 illustrates the second position 'C12' of the secondary heating member 230. In an embodiment, during the stationary stage of the paving operation, the operator may actuate the actuator 244 to rotate the spool 202 in the anti-clock wise direction to move the secondary heating member 230 from the first position 'C11' to the second position 'C12'. In another embodiment, the operator may manually pull the second end 206 of the secondary heating member 230 to move the secondary heating member 230 from the first position 'C11' to the second position 'C12'. In the second position 'C12', the secondary heating member 230 may be disposed on the second portion 102B of the work surface 102. The controller 129 may be further actuated to supply the electric power to the heat conducting element 234 of the secondary heating member 230. Rating of the electric power may be defined based on the amount of heat to be provided on the layer of asphalt disposed on the second portion 102B of the work surface 102 and specification of the blanket 232. Thus, a desired temperature of the asphalt laid on the second portion 102B is maintained during entire time period of the stationary stage of the paving operation to enable effective compaction of the asphalt.

INDUSTRIAL APPLICABILITY

The present disclosure relates to the screed system 110 and a method of paving the work surface 102 by the paving machine 100. The screed system 110 includes the primary heating member 128 disposed on the screed plate 120 to heat the asphalt laid on the work surface 102 during the paving operation. The screed system 110 further includes the secondary heating member 130, 230 for heating the paving material laid on the second portion 102B of the work surface 102 during the stationary stage of the paving operation. The secondary heating member 130, 230 selectively moves from the first position 'C1', 'C11' to the second position 'C2', 'C12', to heat the second portion 102B of the work surface 102.

Referring to FIGS. 1 to 5, the method of paving the work surface 102 is illustrated in detail herein below. The method includes moving the screed plate 120 relative to the work surface 102. The paving width may be regulated by adjusting the pair of extension plates 122. Further, a height of the screed plate 120 and the extension plates 122 with respect to the work surface 102 may be defined based on the thickness of the layer of the asphalt that is to be formed on the work surface 102. The paving machine 100 may be further moved forward to move the screed plate 120 and the extension plates 122 over the work surface 102, and form the layer of the asphalt on the work surface 102. The paving machine 100 may continue to perform the paving operation as long as the asphalt is available in the hopper 112.

The method further includes heating the first portion 102A of the work surface 102 disposed below the screed plate 120 via the primary heating member 128. During the paving operation, the controller 129 may be actuated to supply the electric power to the primary heating member 128. The primary heating member 128 may dissipate the heat to the screed plate 120 which in turn dissipate the heat to the asphalt disposed below the screed plate 120. Further, the primary heating members 128 disposed on the extension plates 122 may also cause heating of the asphalt. Such heating of the asphalt may cause effective compaction of the asphalt as the compactor follows the paving machine 100 during the paving operation.

The method further includes moving the secondary heating member 130, 230 proximal to the second portion 102B of the work surface 102 adjacent to the first portion 102A of the work surface 102. In an embodiment, the timer 135 measures the time that the paving machine 100 has been stationary. If the measured time matches or exceeds the preset time, then the controller 129 communicates with the actuator 144 to move the secondary heating member 130 from the first position 'C1', 'C11' to the second position 'C2', 'C12'. In another embodiment, the controller 129 determines the temperature at the second portion 102B based on the signals received from the temperature sensor 126. If the sensed temperature drops below the preset temperature, then the controller 129 communicates with the actuator 144 to move the secondary heating member 130 from the first position 'C1', 'C11' to the second position 'C2', C12'. In yet another embodiment, during the stationary stage of the paving operation, the operator may actuate the actuator 144, 244 to move the secondary heating member 130, 230 from the first position 'C1', 'C11' to the second position 'C2', 'C12'. In the second position 'C2', 'C12', the secondary heating member 130, 230 may be disposed on the second portion 102B of the work surface 102.

The method further includes heating the second portion 102B of the work surface 102 via the secondary heating member 130, 230. The controller 129 communicably coupled to the secondary heating member 130, 230 is actuated to supply the electric power to the heat conducting element 134, 234, respectively. The heat conducting element 134, 234 may further cause dissipate of the heat to the asphalt laid on the second portion 102B of the work surface 102. Thus, the desired temperature of the asphalt laid on the second portion 102B of the work surface 102 is maintained during entire time period of the stationary stage of the paving operation to enable effective compaction of the asphalt.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A screed system for a paving machine, the screed system comprising:

a screed plate coupled to a screed frame of the paving machine, the screed plate comprising a primary heating member; and a secondary heating member movably coupled to the screed frame and is spaced rearwardly the screed plate.

2. The screed system of claim 1, wherein the secondary heating member is moveable between a first position and a second position.

3. The screed system of claim 2, wherein, in the first position, the secondary heating member is distal to a second portion of a work surface located behind a first portion of the work surface, wherein the first portion is disposed below the screed plate and heated by the primary heating member.

4. The screed system of claim 3, wherein, in the second position, the secondary heating member is proximal to the second portion of the work surface to heat the second portion.

5. The screed system of claim 2 further comprising an actuator coupled to the secondary heating member and the screed frame to move the secondary heating member between the first position and the second position.

6. The screed system of claim 1 further comprising a controller in communication with the secondary heating member.

7. The screed system of claim 6, wherein the controller activates the secondary heating member when a sensed temperature drops below a preset temperature.

8. The screed system of claim 6 further comprising a timer sensing a measured time that the paving machine has been stationary.

9. The screed system of claim 8, wherein the controller activates the secondary heating member when the measured time matches or exceeds a preset time.

10. A paving machine comprising:

a screed system comprising:

a screed frame;

a screed plate coupled to the screed frame, the screed plate having a primary heating member;

a secondary heating member movably coupled to the screed frame and disposed to a rear end of the screed plate; and an actuator coupled to the secondary heating member and the screed frame to move the secondary heating member independently relative to the screed plate.

11. The paving machine of claim 10, wherein, in the first position, the secondary heating member is distal to a second portion of a work surface located behind a first portion of the work surface, wherein the first portion is disposed below the screed plate and heated by the primary heating member.

12. The paving machine of claim 11, wherein, in the second position, the secondary heating member is proximal to the second portion of the work surface to heat the second portion.

13. The paving machine of claim 10 further comprising a controller in communication with the secondary heating member.

14. The paving machine of claim 13, wherein the controller activates the secondary heating member when a sensed temperature drops below a preset temperature.

15. The paving machine of claim 13 further comprising a timer sensing a measured time that the paving machine has been stationary.

16. The paving machine of claim 15, wherein the controller activates the secondary heating member when the measured time matches or exceeds a preset time.

17. The paving machine of claim 13, wherein the controller is in communication with the actuator and moves the secondary heating member between a first position and a second position.

18. A method of paving a work surface by a paving machine comprising:

moving a screed plate relative to the work surface;

heating a first portion of the work surface disposed below the screed plate via a primary heating member;

moving a secondary heating member proximal to a second portion of the work surface, wherein the second portion is located behind the first portion of the work surface; and heating the second portion of the work surface via the secondary heating member.

19. The method of claim 18 further comprising:

sensing a temperature at the second portion of the work surface; and moving the secondary heating member from a first position to a second position when the sensed temperature drops below a preset temperature;

wherein in the first position, the secondary heating member is distal to the second portion of the work surface, and wherein in the second position, the secondary heating member is proximal to the second portion of the work surface to heat the second portion.

20. The method of claim 19 further comprising:

measuring a time that the paving machine has been stationary; and moving the secondary heating member from the first position to the second position when the measured time matches or exceeds a preset time.

* * * * *